United States Patent [19]

Ferrari

[11] Patent Number: 4,685,609

[45] Date of Patent: Aug. 11, 1987

[54] APPARATUS COMPRISING PLANAR ELEMENTS WHICH MAY BE ASSEMBLED TOGETHER TO FORM A STRUCTURE

[75] Inventor: Hubert Ferrari, Le Val St André , France

[73] Assignee: Societe Coninentale du Carton Ondule Socar, Saint Mande, France

[21] Appl. No.: 869,092

[22] Filed: May 30, 1986

[30] Foreign Application Priority Data

Aug. 21, 1985 [FR] France ..... 85 12594

[51] Int. Cl.[4] ..... B65D 5/48

[52] U.S. Cl. ..... 229/15; 217/32; 229/42

[58] Field of Search ..... 229/15, 27, 28 R, 42, 229/117; 217/30–32

[56] References Cited

U.S. PATENT DOCUMENTS

| | | | |
|---|---|---|---|
| 203,356 | 5/1878 | McCarren | 217/32 |
| 529,173 | 11/1894 | Herr | 217/32 |
| 533,331 | 1/1895 | Williams | 217/32 |
| 652,126 | 6/1900 | Lion berger | 217/32 |
| 2,466,275 | 4/1949 | Ringel | 217/32 |
| 3,767,106 | 10/1973 | Morgan | 229/15 |
| 4,544,092 | 10/1985 | Palmer | 229/15 |
| 4,548,350 | 10/1985 | Engle et al. | 229/15 |
| 4,591,090 | 5/1986 | Collins et al. | 229/15 |

*Primary Examiner*—Stephen Marcus
*Assistant Examiner*—Gary E. Elkins
*Attorney, Agent, or Firm*—Scully, Scott, Murphy & Presser

[57] ABSTRACT

The invention concerns an apparatus comprising first and second planar elements, e.g. of cardboard, which may be assembled together to form a structure, e.g. a cross brace of a bottle crate. Each of these elements has a slit which extends to an edge of the respective element and into which the other element may be introduced. The slits of the two elements have linear portions which are aligned in a predetermined direction when the elements are assembled. The slit of the first element is formed to provide a flap which extends transversely with respect to the predetermined direction and which is pivotable about a folding line which extends obliquely with respect to the predetermined direction. The second element has an aperture in which the flap is engaged with the elements are assembled. Assembly of the elements in a mutually orthogonal position permits the flap to be freely pivoted about the folding line without engaging an edge of the aperture, while subsequent movement of the elements from the orthogonal position to a further position in which they lie against one another prevents the flap from pivoting freely about the folding line without engaging an edge of the aperture.

7 Claims, 9 Drawing Figures

APPARATUS COMPRISING PLANAR ELEMENTS WHICH MAY BE ASSEMBLED TOGETHER TO FORM A STRUCTURE

BACKGROUND OF THE INVENTION

The present invention relates to apparatus comprising planar elements, e.g. of a semi-rigid material such as corrugated cardboard, the elements being able to be assembled together to form a structure, e.g. a cross brace of a bottle crate. Although the invention is not so restricted, it relates more particularly to apparatus in which the assembled elements, by being pivoted, can be brought flat against one another and can be locked in the assembled position both when flat and after being opened out.

A cross brace for a bottle crate consists of sheets of cardboard or corrugated carboard notched at regular intervals over some of their height with slits, into which the corresponding slits of similar sheets are engaged so as to form a unit which, together with a cardboard case in which it is accommodated, defines a plurality of identical receptacles for bottles.

Cross braces can be stored flat after assembly. It is also common to accommodate them in advance in American-style cases in which they are used, the cross braces sometimes being fixed by means of glueing to an inner face of these cases. In the latter situation, it is the cases themselves which are stored flat, together with the cross braces which they contain.

It is therefore important to ensure, both when the cross braces are installed in the cases and when they are opened out, that there is no risk of their component elements coming away from one another.

The same applies when the case is full of bottles, in particular when the cross braces used are of the so-called "economy" type, in which the receptacles of the cross braces only protect the bottles up to their shoulder.

It is therefore desirable that the component elements of the cross brace should be locked, once assembled, whatever their relative positions and whatever the manipulations to which they are subjected during the time when they are opened out or after this.

To achieve this, it has already been proposed in French Patent Specification No. 2,154,339 to lock, in the assembled position, two sheets of cardboard having notches in which the sheets are interleaved with one another, at the same time giving the notches of one of the sheets a non-rectilinear profile defining a tooth which can be engaged in a slit made in the corresponding position in the other sheet.

Such a system ensures excellent locking of two sheets joined together, when they are in the position of use, that is to say when they are perpendicular to one another. In contrast to this, however, when the sheets are folded flat, the teeth can very easily escape from their slits, simply because the sheets slide in contact with one another, and there is no security in this position.

SUMMARY OF THE INVENTION

According, therfore, to the present invention, there is provided apparatus comprising first and second planar elements which may be assembled together to form a structure, each element having a slit which extends to an edge of the respective element and into which the other element may be introduced, the slits having linear portions which are aligned in a predetermined direction when the elements are so assembled, the slit of the first element being formed to provide a flap which extends transversely with respect to the said predetermined direction and which is pivotable about a folding line which extends obliquely with respect to the said predetermined direction, the second element having an aperture in which the flap is engaged when the elements are assembled, assembly of the elements in a mutually orthogonal position permitting the flap to be freely pivoted about the folding line without engaging an edge of the aperture, and subsequent movement of said elements from the orthogonal position to a further position in which they lie against one another preventing the flap from pivoting freely about the folding line without engaging a said edge.

The arrangement is preferably such that the elements may be locked in the assembled position, whatever the angle formed by the said elements and even when they are folded flat against one another.

The two elements can thus be joined together in a position in which they are perpendicular to one another, by engaging each of the said elements into the slit of the other element in the customary way. The said flap may be moved aside by pivoting it about its folding line when it encounters a solid part of the second element, and, when it is opposite the aperture in the second element, it may be arranged to return as a result of elasticity into the plane of the first element by passing through the said aperture. In this position, in which the two elements are perpendicular to one another with the flap engaged in the associated aperture, perpendicularly relative to the plane of the aperture, the flap prevents the two elements from coming away from one another.

If the two elements are then pivoted relative to the axis constituted by the aligned linear portions of their slits so as to bring them flat against one another, the folding line will be on one side of the second sheet, whilst part of the flap will be on the other side of the second sheet, since the flap cannot pivot freely about its folding line in this position. Consequently, in this position too, the flap will remain engaged obliquely in the associated aperture and the two elements will therefore be locked in the assembled position under all circumstances.

If desired, each of the elements can have a flap adapted to be engaged into an aperture of the other element, and an aperture adapted to receive a flap of the other element.

Such apparatus is therefore especially suitable for locking in the assembled position elements of cross braces for bottle crates, since it does not require any appreciable change in their production or assembly. It should be noted, moreover, that there is self-locking of the elements during assembly, the flap automatically engaging in the associated aperture.

The flap and the associated aperture can have many shapes. For example, the flap and the aperture can have a substantially triangular profile, one of the sides of the triangle in the case of the flap consisting of its folding line and, in the case of the aperture, consisting of an extension of the linear portion of the slit in the second element. Preferably, the aperture has a shape which is symmetrical relative to the linear portion of the said slit, so that the flap, by pivoting about its folding line, can move aside in one direction or the other equally, before engaging in the aperture, when the two elements are joined together.

The flap and the aperture can also have curved profiles.

BRIEF DESCRIPTIOIN OF THE DRAWINGS

The invention is illustrated, merely by way of example, in the accompanying drawings, in which.

Figure 5:
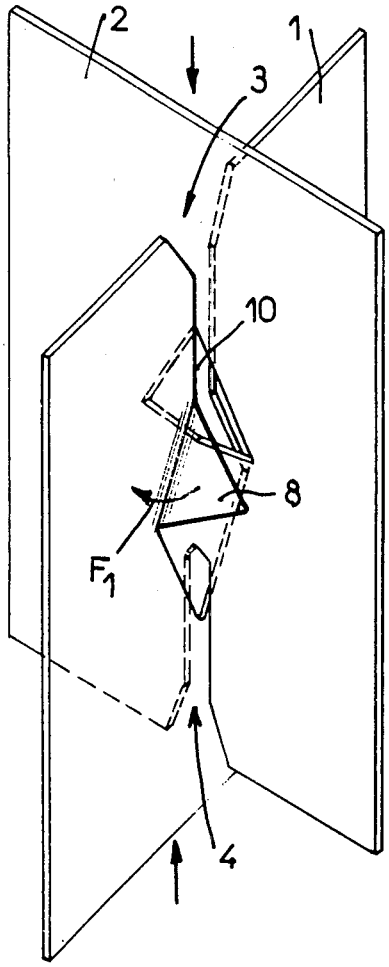
FIGS. 5 and 6 are perspective views of the sheets of FIGS. 1 and 2 arranged perpendicularly to one another, during assembly and after assembly respectively.
Figure 6:
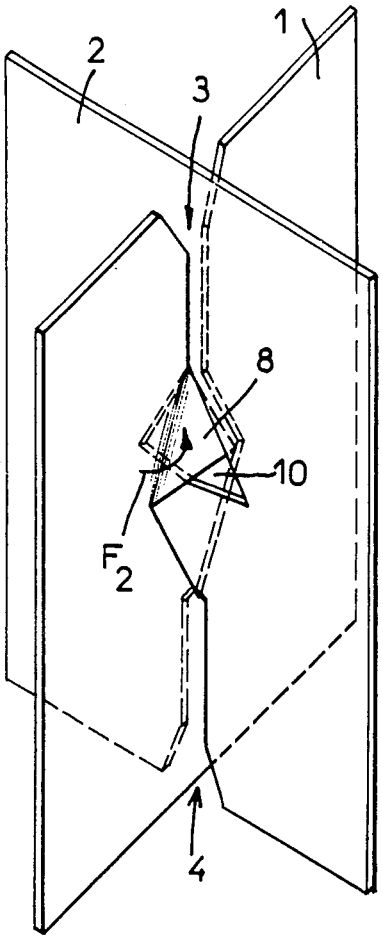
Figure 7:
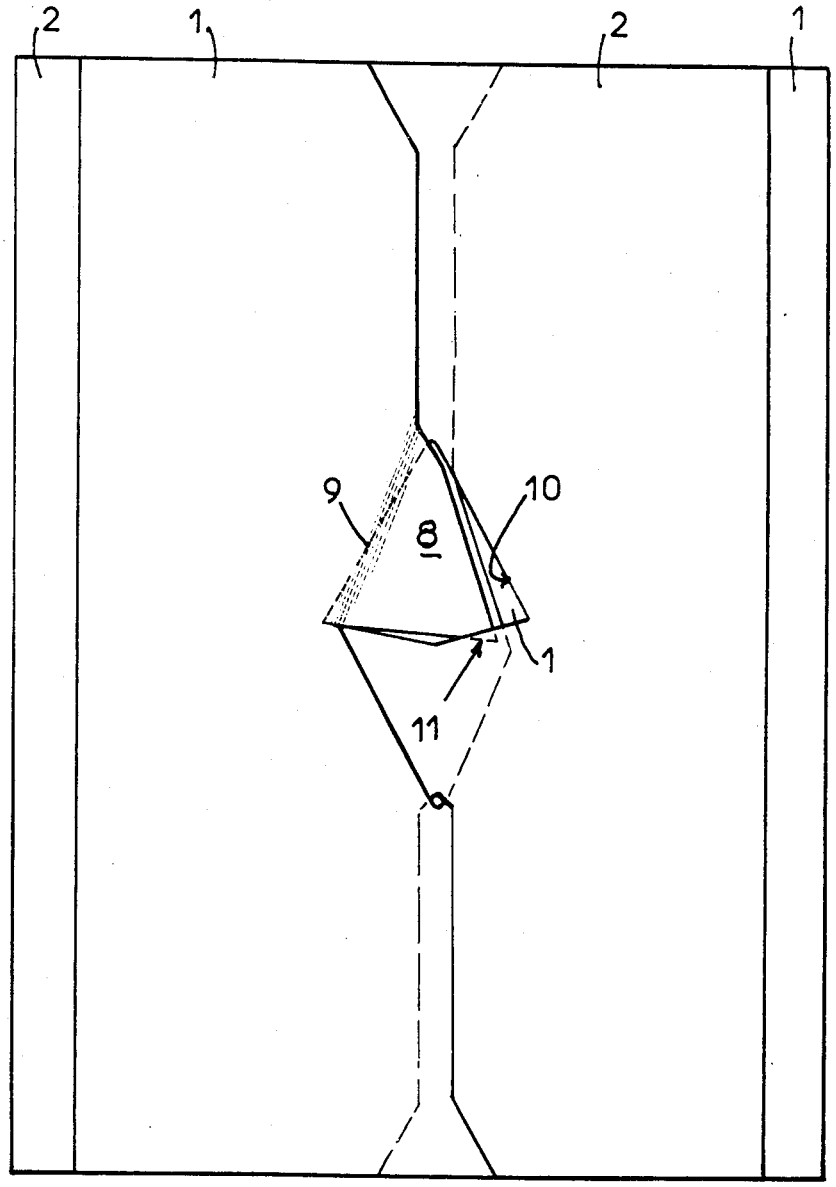
Figure 8:
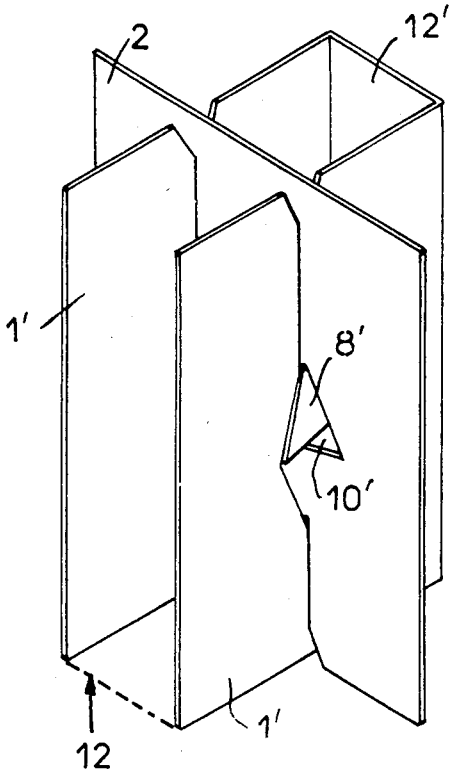
Figure 9:
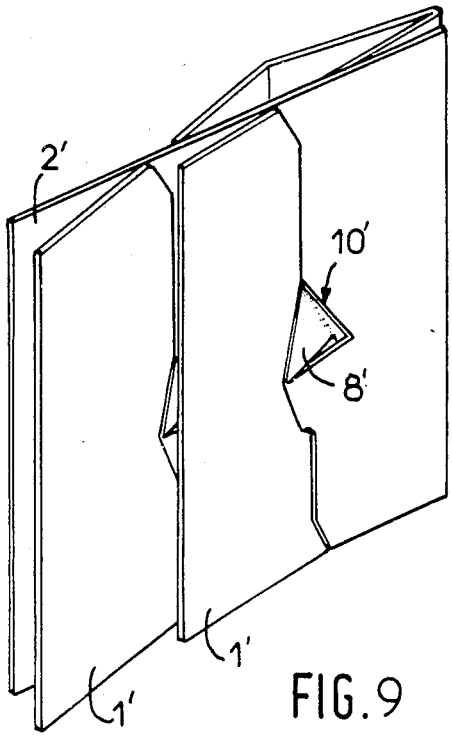

FIG. 7 shows the two assembled sheets laid against one another, after pivoting 90° relative to the position shown in FIGS. 5 and 6; and FIGS. 8 and 9 are perspective views illustrating the use of the said structure in a cross brace for a bottle crate, shown respectively in the position of use and when folded flat.

DESCRIPTION OF THE PREFERRED EMBODIMENT

Figure 2:
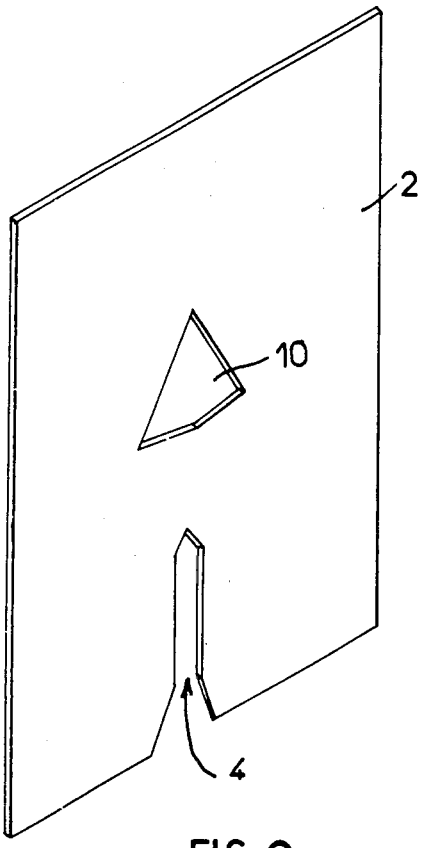
FIGS. 1 and 2 are perspective views of two cardboard sheets capable of being joined together to form a structure to the present invention.
Figure 1:
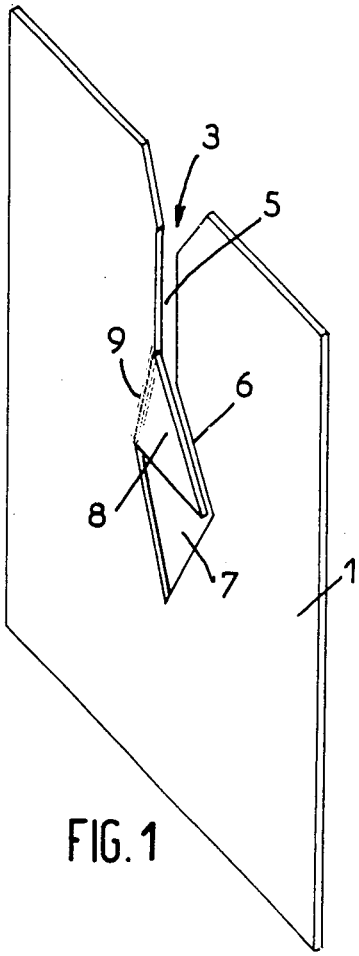
Figure 4:
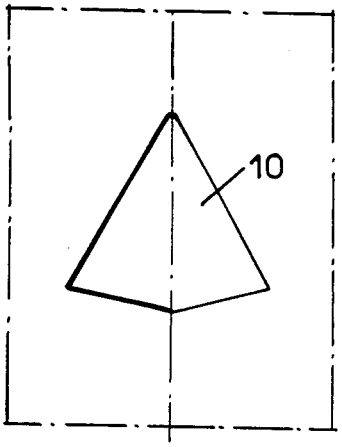
FIGS. 3 and 4 are views on a larger scale of a flap of one of these sheets and of an aperture in the other sheet respectively.
Figure 3:
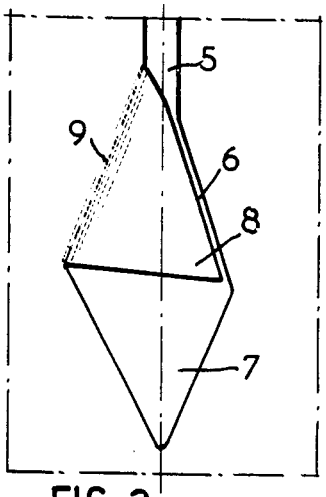

The cardboard sheets 1 and 2 shown in FIGS. 1 and 2 have, starting from one edge, a slit 3 and a slit 4 respectively, making it possible to join them together by interleaving them with one another and, after assembly, to pivot them about an axis identified by the general direction of the slits 3, 4.

The slit 4 of the sheet 2 is substantially rectilinear, whilst the slit 3 of the sheet 1 has a substantially rectilinear part 5 which is of a length equal to that of the slit 4 and which is aligned with the latter in the assembled position. The part 5 of the slit 3 is extended by parts 6 and 7 so as to form a flap 8 which is pivotable on the sheet 1 by means of a folding line 9 arranged obliquely relative to the part 5 of the slit 3.

An aperture of cut-out 10 is made in the sheet 2, in such a position that, in the assembled position, the flap 8 can freely extend into it when the sheets are joined together in a position in which they are perpendicular to one another. The shape of this cut-out 10 is such that, when the two elements 1 and 2 are joined together so as to be perpendicular to one another (the position shown in FIG. 6), the flap 8 can pivot freely about the folding line 9 without encountering the edges of the cut-out 10, whereas, when they are joined together and laid against one another (the position shown in FIG. 7), the flap 8 cannot pivot about the line 9 without being stopped by one or some of the edges of the cut-out 10.

Many shapes of the flap 8 and cut-out 10 satisfy these conditions. In the drawings, the flap 8 has a substantially triangular shape, whilst the cut-out 10 has a profile which is symmetrical relative to the axis of the slit 4 and which is in the shape of a quadrilateral formed by two identical triangles placed next to one another. Alternatively, the base of this quadrilateral could have a curved form, for example that of an arc of a circle, or the cut-out 10 could be of substantially triangular shape.

The sheets 1 and 2 may be joined together in the way illustrated in FIGS. 5 and 6. With the sheets perpendicular to one another, they may be engaged respectively into the slit 3 or 4 of the other sheet in the usual way. In the course of the sheets 1, 2 being interleaved with one another, the flap 8 is gradually pushed back by the sheet 2 and pivots laterally as indicated by the arrow $F_1$ (FIG. 5) so as to move aside, until it comes opposite the cut-out 10. As a result of its elasticity, it then pivots in the opposite direction as indicated by the arrow $F_2$, so as to extend into the cut-out 10, thus returning into the plane of the sheet 1 and locking the sheets in the assembled position (FIG. 6). There is therefore self-locking of the two sheets, without any manual or mechanical action being necessary to engage the flap 8 in the slit 10.

If the sheets 1, 2 are then pivoted about the axis constituted by the parts of the slits 3 and 4 which are aligned with one another, so as to bring them flat against one another (FIG. 7), the flap 8 cannot escape from the cut-out 10 by pivoting about the folding line 9, since its tip 11, by pivoting, would encounter the lower edge of the cut-out 10. It therefore remains engaged obliquely in the latter, and, even in this folded-flat position, the two sheets cannot come away from one another.

If desired, each of the sheets 1, 2 can have a flap and a cut-out for receiving the flap of the other sheet.

As stated above, such an assembly system is therefore particularly suitable for locking in the assembled position elements of a cross brace of bottle crates. This can be clearly seen in FIGS. 8 and 9, where the components already described with relation to the preceding Figures are designated by the same reference numerals bearing the index'.

The cross brace shown in these Figures comprises a sheet 2' joined according to the invention to two parallel sheets 1' which, together with a connecting element 12', form an assembly of U-shaped cross-section which, in a way known per se, can be fixed to the inner wall of an American-style case by glueing the element 12' against this wall. In the drawing, the element 12' representing the base of the U is parallel to the sheet 2', but it could also be perpendicular to this wall (as indicated at 12'' in FIG. 8), so as to be arranged on the bottom of the case after the latter has been assembled in its final shape.

The invention thus provides a very simple system, easy to produce and assemble, for locking in all positions two plane elements joined together by interleaving a system of slits with one another.

What is claimed is:

1. Apparatus comprising first and second planar elements which may be assembled together to form a structure, each element having a slit which extends to an edge of the respective element and into which the other element may be introduced, the slits having linear portions which are aligned in a predetermined direction when the elements are so assembled, the slit of the first element being formed to provide a flap which extends transversely with respect to said predetermined direction and which is pivotable about a folding line which extends obliquely with respect to said predetermined direction, said flap having an inner flap edge, inner with respect to the slit of the first element, which extends at a first angle with respect to said predetermined direction, the second element having an aperture in which the flap is engaged when the elements are assembled, said aperture having a V shaped aperture edge, with the base of the V being aligned with the slit in said second element along said predetermined direction, and the legs of the V extending away from the slit, and one leg of the V forming an interference aperture edge which extends at a second angle, different from said first angle, with respect to said predetermined direction, with said flap edge being next to said interference aperture edge but angled with respect thereto because of the different first and second angles, and wherein movement of said elements from an orthogonal position to a position in which they lie against one another results in said flap edge contacting and engaging said interference aperture edge to prevent the flap from pivoting freely about the folding line to prevent said first and second planar elements from becoming disengaged from each other.

2. An apparatus as claimed in claim 1 in which the flap has a substantially triangular shape.

3. An apparatus as claimed in claim 1 in which the aperture has a substantially triangular shape.

4. An apparatus as claimed in claim 1 in which the aperture has a quadrilateral shape which is symmetrical with respect to the said predetermined direction.

5. An apparatus as claimed in claim 1 in which each of the planar elements is made of cardboard.

6. A structure comprising first and second planar elements each of which has a slit which extends to an edge of the respective element and in which slit the other element is engaged, the slits having linear portions which are aligned in a predetermined direction, the slit of the first element being formed to provide a flap which extends transversely with respect to said predetermined direction, said flap having an inner flap edge, inner with respect to the slit of the first element, which extends at a first angle with respect to said predetermined direction, the second element having an aperture in which the flap is engaged when the elements are assembled, said aperture having a V shaped aperture edge, with the base of the V being aligned with the slit in said second element along said predetermined direction, and the legs of the V extending away from the slit, and one leg of the V forming an interference aperture edge which extends at a second angle, different from said first angle, with respect to said predetermined direction, with said flap edge being next to said interference aperture edge but angled with respect thereto because of the different first and second angles, and wherein movement of said element from an orthogonal position to a position in which they lie against one another results in said flap edge contacting and engaging said interference aperture edge to prevent the flap from pivoting freely about the folding line to prevent said first and second planar elements from becoming disengaged from each other.

7. A structure as claimed in claim 6 in which the structure constitutes a cross brace of a crate.

* * * * *